US010696506B2

(12) United States Patent
Hannen et al.

(10) Patent No.: US 10,696,506 B2
(45) Date of Patent: Jun. 30, 2020

(54) METHOD AND APPARATUS FOR TRANSFERRING FILM WOUND ONTO WINDING MANDREL, ORIENTED VERTICALLY AND SUPPORTED EXCLUSIVELY AT UPPER END THEREOF

(71) Applicant: MSK—Verpackungs-Systeme GmbH, Kleve (DE)

(72) Inventors: Reiner Hannen, Kalkar-Wissel (DE); Enrico Czok, Kleve (DE)

(73) Assignee: MSK—Verpackungs-Systeme GmbH, Kleve (DE)

( * ) Notice: Subject to any disclaimer, the term of this patent is extended or adjusted under 35 U.S.C. 154(b) by 307 days.

(21) Appl. No.: 15/788,137

(22) Filed: Oct. 19, 2017

(65) Prior Publication Data

US 2018/0111774 A1 Apr. 26, 2018

(30) Foreign Application Priority Data

Oct. 20, 2016 (EP) ..... 16194883

(51) Int. Cl.
*B65H 16/04* (2006.01)
*B65H 18/10* (2006.01)
(Continued)

(52) U.S. Cl.
CPC ..... *B65H 18/103* (2013.01); *B65B 69/0033* (2013.01); *B65H 16/04* (2013.01); *B65H 18/026* (2013.01); *B65H 19/30* (2013.01); *B65H 20/005* (2013.01); *B65H 2301/41852* (2013.01); *B65H 2301/41859* (2013.01); *B65H 2404/144* (2013.01); *B65H 2404/147* (2013.01);
(Continued)

(58) Field of Classification Search
CPC .. B65H 18/026; B65H 18/103; B65H 20/005; B65H 19/30; B65H 16/104; B65B 69/0033
See application file for complete search history.

(56) References Cited

U.S. PATENT DOCUMENTS 5,727,747 A 3/1998 Hannen et al.
5,911,666 A * 6/1999 Lancaster, III ..... B65B 69/00 414/412
(Continued)

FOREIGN PATENT DOCUMENTS

EP 0636543 2/1995
EP 0720564 7/1996

*Primary Examiner* — Sang K Kim
(74) *Attorney, Agent, or Firm* — Berenato & White, LLC

(57) ABSTRACT

A method is disclosed for transferring a film, preferably a wound-on stretch film, wound onto a winding mandrel, oriented in particular vertically and preferably supported exclusively in the region of its upper end, of an unwrapping apparatus, such that when the transfer position of the winding mandrel is reached, the film wound onto the winding mandrel is pulled off the winding mandrel by means of at least one transfer device and delivered to a disposal area. An apparatus for transferring a film, preferably a wound-on stretch film, wound onto a winding mandrel, oriented in particular vertically and preferably supported exclusively in the region of its upper end, of an unwrapping apparatus, is disclosed. The apparatus encompasses at least one transfer device for pulling off the film wound onto the winding mandrel when the transfer position of the winding mandrel is reached.

19 Claims, 12 Drawing Sheets

(51) Int. Cl.

| | |
|---|---|
| ***B65B 69/00*** | (2006.01) |
| ***B65H 18/02*** | (2006.01) |
| ***B65H 19/30*** | (2006.01) |
| ***B65H 20/00*** | (2006.01) |

(52) U.S. Cl.
CPC ..... *B65H 2406/31* (2013.01); *B65H 2408/24* (2013.01); *B65H 2701/1752* (2013.01); *B65H 2701/1944* (2013.01)

(56) References Cited

U.S. PATENT DOCUMENTS

| | | | | |
|---|---|---|---|---|
| 6,766,630 | B2 * | 7/2004 | Rutten | B65B 69/0025 242/527 |
| 2003/0177740 | A1 * | 9/2003 | Rutten | B65B 69/0025 53/492 |

* cited by examiner

METHOD AND APPARATUS FOR TRANSFERRING FILM WOUND ONTO WINDING MANDREL, ORIENTED VERTICALLY AND SUPPORTED EXCLUSIVELY AT UPPER END THEREOF

RELATED APPLICATIONS AND CLAIM TO PRIORITY

This application is related to application no. 16194883.1, filed Oct. 20, 2016, in the European Patent Office, the complete disclosure of which is incorporated herein by reference and to which priority is claimed.

BACKGROUND AND FIELD OF THE INVENTION

Unwrapping apparatuses are used in practice in order to unwrap a goods stack packaged with a film. The film is removed upon unwrapping, a winding mandrel that is supported at the upper end being guided around the goods stack that is to be unwrapped. The film is gripped by the winding mandrel and wound onto it. It is disadvantageous in this context that stretch films in particular tend to stick, so that the film adheres to the winding mandrel. After each unwinding operation, the stretch film must be laboriously unrolled manually from the winding mandrel for the next unwrapping operation. For wound-on shrink-wrap films, the winding mandrel must firstly be moved oppositely to the rotation direction upon unwrapping, so that the film can slip off the winding mandrel.

SUMMARY OF THE INVENTION

An object of the invention is to describe a method that avoids the disadvantages recited above and makes possible simple removal of the wound-on film from the winding mandrel.

This object is achieved by a method for transferring a film, preferably a wound-on stretch film, wound onto a winding mandrel, oriented in particular vertically and preferably supported exclusively in the region of its upper end, of an unwrapping apparatus, such that when the transfer position of the winding mandrel is reached, the film wound onto the winding mandrel is pulled off the winding mandrel by means of at least one transfer device and delivered to a disposal area. The transfer device can be embodied, for example, as a gripping device that grips the film by means of corresponding grippers and pulls it off the winding mandrel. The film can then be delivered to a disposal area. By means of the method according to the present invention, the film is pulled off considerably more quickly than if a film were to slip downward, solely under its own weight, off the winding mandrel. Any type of film can be pulled off by means of the method according to the present invention. The method is also suitable in particular for pulling off stretch films, which tend to stick. These can be pulled off easily and quickly from the winding mandrel.

The winding mandrel on the one hand, and at least a sub-region of the transfer device, preferably the entire transfer device, on the other hand, can be displaceable relative to one another in a horizontal direction and/or in a vertical direction. For a corresponding displacement, the winding mandrel and/or the transfer device can each be mounted, for example, on a horizontally displaceable carriage. If a vertical displacement is desired, the winding mandrel and/or the transfer device can each be connected, for example, to a cylinder acting in vertical terms.

It is useful if at least a sub-region of the transfer device, preferably the entire transfer device, is horizontally and/or vertically displaceable.

The film wound onto the winding mandrel can protrude at the bottom with respect to the lower end of the winding mandrel, forming a fringe. The film can be immobilized in the region of the fringe for the transfer operation in secure and simple fashion, for example by clamping, and then pulled off.

It is useful if a displacement of the winding mandrel and/or a displacement at least of a sub-region of the transfer device, preferably of the entire transfer device, occurs without contact between the fringe and the transfer device. This ensures that the orientation of the fringe prior to displacement and the orientation of the fringe after displacement remains unchanged, and that the fringe has not become folded over due to contact upon displacement. The fringe of course also does not come into contact, upon displacement, with any other component of the apparatus for carrying out the method.

In the transfer position, the lower end of the winding mandrel can be arranged above the transfer device, i.e. in the region above the transfer device.

At least one transfer device can encompass at least one drivable roller that interacts with the adjacent sub-region of the winding mandrel in order to pull off the film. The sub-region is preferably made up of a friction-minimizing material or has a friction-minimizing coating. The surface of the sub-region can, for example, also have been treated in friction-minimizing fashion.

At least one transfer device can encompass at least two rollers that form a gap between them and preferably are displaceable with respect to one another in order to modify the width of the gap, at least one of the two rollers being driven by a drive system.

In order to convey the film to the disposal area, an aspiration system encompassing a suction opening can be used for further transport of the film that is in the process of being pulled off.

Unwrapping apparatuses are used in practice in order to unwrap a goods stack packaged with a film. The film is removed upon unwrapping, a winding mandrel that is supported at the top being guided around the goods stack that is to be unwrapped. The film is gripped by the winding mandrel and wound onto it. It is disadvantageous in this context that stretch films in particular tend to stick, so that the film adheres to the winding mandrel. After each unwinding operation, the stretch film must be laboriously unrolled manually from the winding mandrel for the next unwrapping operation. For wound-on shrink-wrap films, the winding mandrel must firstly be moved oppositely to the rotation direction upon unwrapping so that the film can slip off the winding mandrel.

An object of the invention is to describe an apparatus that avoids the disadvantages recited above and makes possible simple removal of the wound-on film from the winding mandrel.

This object is achieved by an apparatus for transferring a film, preferably a wound-on stretch film, wound onto a winding mandrel, oriented in particular vertically and preferably supported exclusively in the region of its upper end, of an unwrapping apparatus, in particular for carrying out the method according to one of the Claims, the apparatus encompassing at least one transfer device for pulling off the film wound onto the winding mandrel when the transfer position of the winding mandrel is reached. The transfer device can be embodied, for example, as a gripping device that grips the film by means of corresponding grippers and pulls it off the winding mandrel. The film can then be delivered to a disposal area. By means of the apparatus according to the present invention, the film is pulled off considerably more quickly than if a film were to slip downward, solely under its own weight, off the winding mandrel. Any type of film can be pulled off by means of the apparatus according to the present invention. The apparatus is also suitable in particular for pulling off stretch films, which tend to stick. These can be pulled off easily and quickly from the winding mandrel.

The winding mandrel on the one hand, and at least a sub-region of the transfer device, preferably the entire transfer device, on the other hand, can be arranged displaceably relative to one another in a horizontal direction and/or in a vertical direction. For a corresponding displacement, the winding mandrel and/or the transfer device can each be mounted, for example, on a horizontally displaceable carriage. If a vertical displacement is desired, the winding mandrel and/or the transfer device can each be connected, for example, to a cylinder acting in vertical terms.

At least a sub-region of the transfer device, preferably the entire transfer device, can be arranged horizontally and/or vertically displaceably.

At least one transfer device can encompass at least one drivable roller that interacts with the adjacent sub-region of the winding mandrel in order to pull off the film. The sub-region is preferably made up of a friction-minimizing material or has a friction-minimizing coating. The surface of the sub-region can, for example, also have been treated in friction-minimizing fashion.

At least one transfer device can encompass at least two rollers that form a gap between them and preferably are displaceable with respect to one another in order to modify the width of the gap, at least one of the two rollers being driven by a drive system.

The two rollers that form a gap between them, and are closest to the, preferably lower, end of the winding mandrel, can be oriented horizontally.

The two rollers that form a gap between them, and are closest to that end of the winding mandrel over which the film is to be pulled off, can furthermore be arranged in alignment with that end of the winding mandrel over which the film is to be pulled off. The film can thus be securely gripped by the rollers for the purpose of being pulled off.

At least a sub-region of the surface of at least one drivable roller can comprise a friction-increasing surface, for example a rubber coating. The film can thereby be effectively pulled off.

In order to convey the film to the disposal area, the apparatus can comprise an aspiration system encompassing a suction opening for further transport of the film that is in the process of being pulled off.

It is useful in this context if the suction opening is arranged in alignment with that end of the winding mandrel over which the film is to be pulled off.

A delivery device, in particular a delivery device embodied as a funnel, can furthermore be provided in order to deliver the pulled-off film to the disposal area. A configuration of this kind is useful, for example, if the disposal area is embodied as a container and if the film pulled off by the transfer device is transferred solely by its own weight, after being pulled off, into the container preferably arranged below the transfer device.

The apparatus can comprise, in the region in which the winding mandrel is located in its transfer position, a detection device that activates the transfer device upon detection of a winding mandrel having a film wound thereunto. The detection device can be embodied, for example, as a light barrier.

BRIEF DESCRIPTION OF THE DRAWINGS

The invention will be explained below with reference to the drawings, in which.

Figure 1:
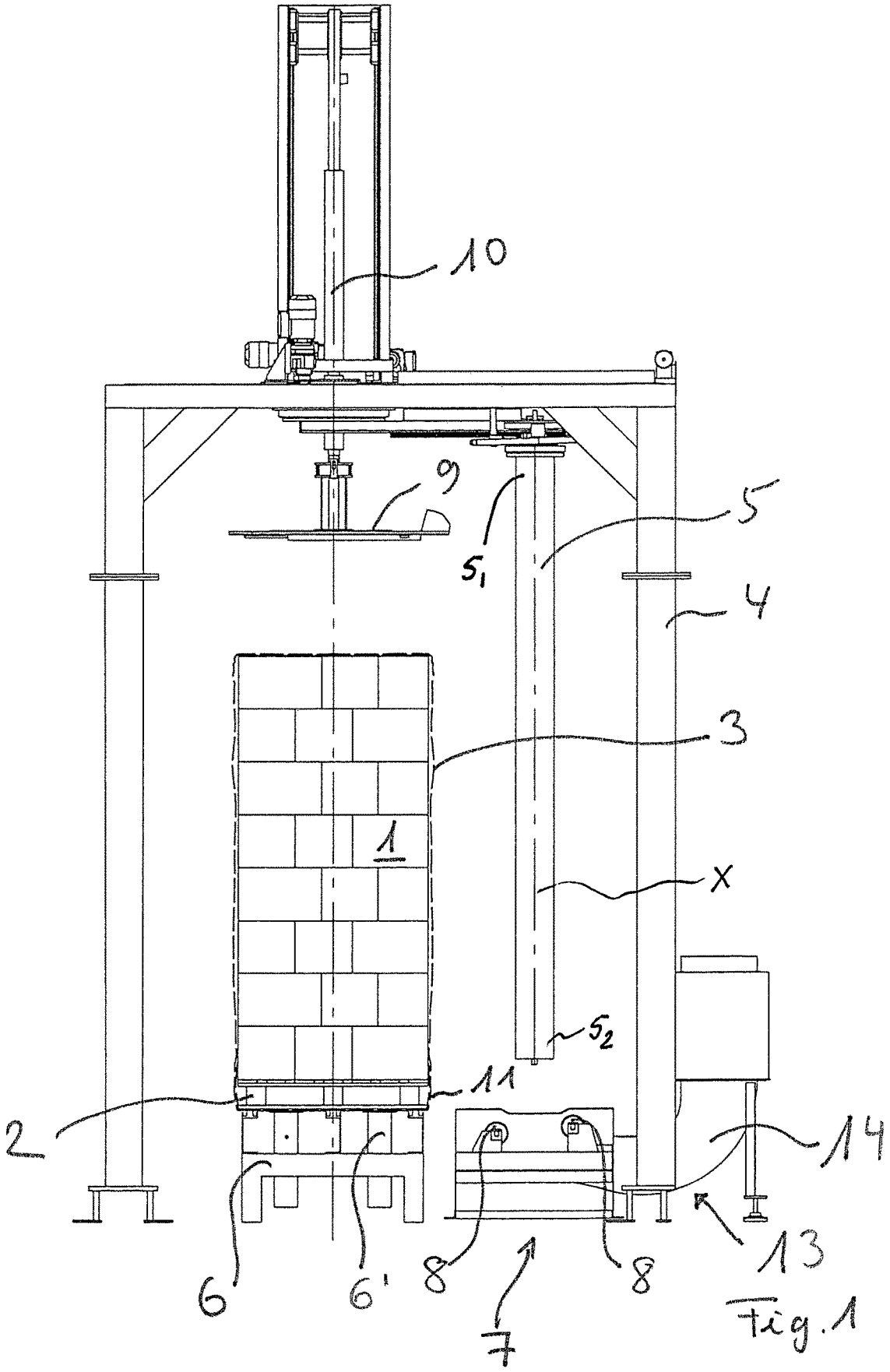
FIGS. 1 to 5 are side views of a first exemplifying embodiment of an apparatus according to the present invention and of a method according to the present invention, at different points in time.

In all the Figures, matching reference characters are used for identical or similar components.

DETAILED DESCRIPTION OF THE PREFERRED EMBODIMENT(S)

A goods stack 1 is, as a rule, arranged on a pallet 2 and is secured with a film 3. Such a film 3 can be, for example, a shrink-wrap film, a stretch film, a stretch hood film, or a stretch wrap film. A goods stack 1 packaged with such a film 3 is unwrapped using an unwrapping apparatus, for subsequent removal of the individual goods of goods stack 1.

An unwrapping apparatus comprises a frame 4 having a winding mandrel 5. Winding mandrel 5 is movable in all directions in a horizontal direction by way of a configuration that is not depicted in further detail. Winding mandrel 5 can thereby be guided externally around goods stack 1 along the side edges for the purpose of unwrapping.

The winding mandrel 5 can be rotated around its own longitudinal axis X by means of a drive system (not depicted), and is supported at an upper end $\mathbf{5}_1$ thereof and is oriented vertically. A lower end $\mathbf{5}_2$ of the winding mandrel 5 is freely suspended. The winding mandrel 5 is usually split in two when viewed in its longitudinal dimension, and is made up of a stationary bar and a bar that is pivotable with respect to the stationary bar.

An unwrapping apparatus furthermore usually comprises an aspiration device (not depicted in further detail) and a cutting device (not depicted in further detail). For unwrapping purposes, the aspiration device is moved against goods stack 1, the aspiration device being aspirated into place against film 3. The aspiration device is then moved via a cylinder toward winding mandrel 5. As a result, the aspirated film 3 is pulled against the cutting device and film 3 is thereby cut through vertically. If film 3 also comprises an underlayer, that is also cut through vertically.

The free vertical edge of film 3 is then introduced into the interstice between the stationary bar and the pivotable bar. Once the pivotable bar is swung in, the corresponding edge of film 3 is clamped in between the stationary bar and the pivotable bar. Winding mandrel 5 then rotates around its longitudinal axis and is moved simultaneously around goods stack 1 so that film 3 is thereby wound on. If film 3 also comprises an underlayer, film 3 is wound on in that region as well.

The speed at which winding mandrel 5 is guided around the rectangular goods stack 1, and the rotation speed of winding mandrel 5, are coordinated with the contour of goods stack 1 so that film 3 is uniformly wound on upon unwrapping. During unwrapping of the first two side surfaces film 3 can be immobilized, for example by means of PTFE clamping pieces, centeredly on that side surface of goods stack 1 which is located oppositely from the cut side. In supplementary fashion, film 3 can also be held by means of PTFE clamping pieces at the fourth corner, i.e. the last corner of goods stack 1 that is unwrapped, until shortly before the end of the unwrapping process.

As is evident from the Figures, the unwrapping apparatus encompasses a conveyor 6 on which goods stack 1 to be unpacked is transported into frame 4. Arranged in the region of the unwrapping apparatus in conveyor 6 is a lifting system 6' in order to allow goods stack 1 to be raised for unwrapping purposes. Arranged next to conveyor 6 is a transfer device 7 that comprises, in the exemplifying embodiment depicted, two rollers 8 that form a gap between them. The rollers 8 are displaceable with respect to one another in order to modify the width of the gap. At least one of the two rollers 8 is drivable by means of a drive system 18 (best shown in FIG. 2). In FIG. 1, the two rollers 8 are at a greater distance from one another so that the gap is wide. Winding mandrel 5 has not yet been moved against goods stack 1, enveloped by film 3, for unwrapping. Winding mandrel 5 is instead in the transfer position, so that the lower end $\mathbf{5}_2$ of winding mandrel 5, over which the film 3 will later be pulled off, is in alignment with the transfer device, i.e. with the gap formed by the two rollers 8.

Figure 2:
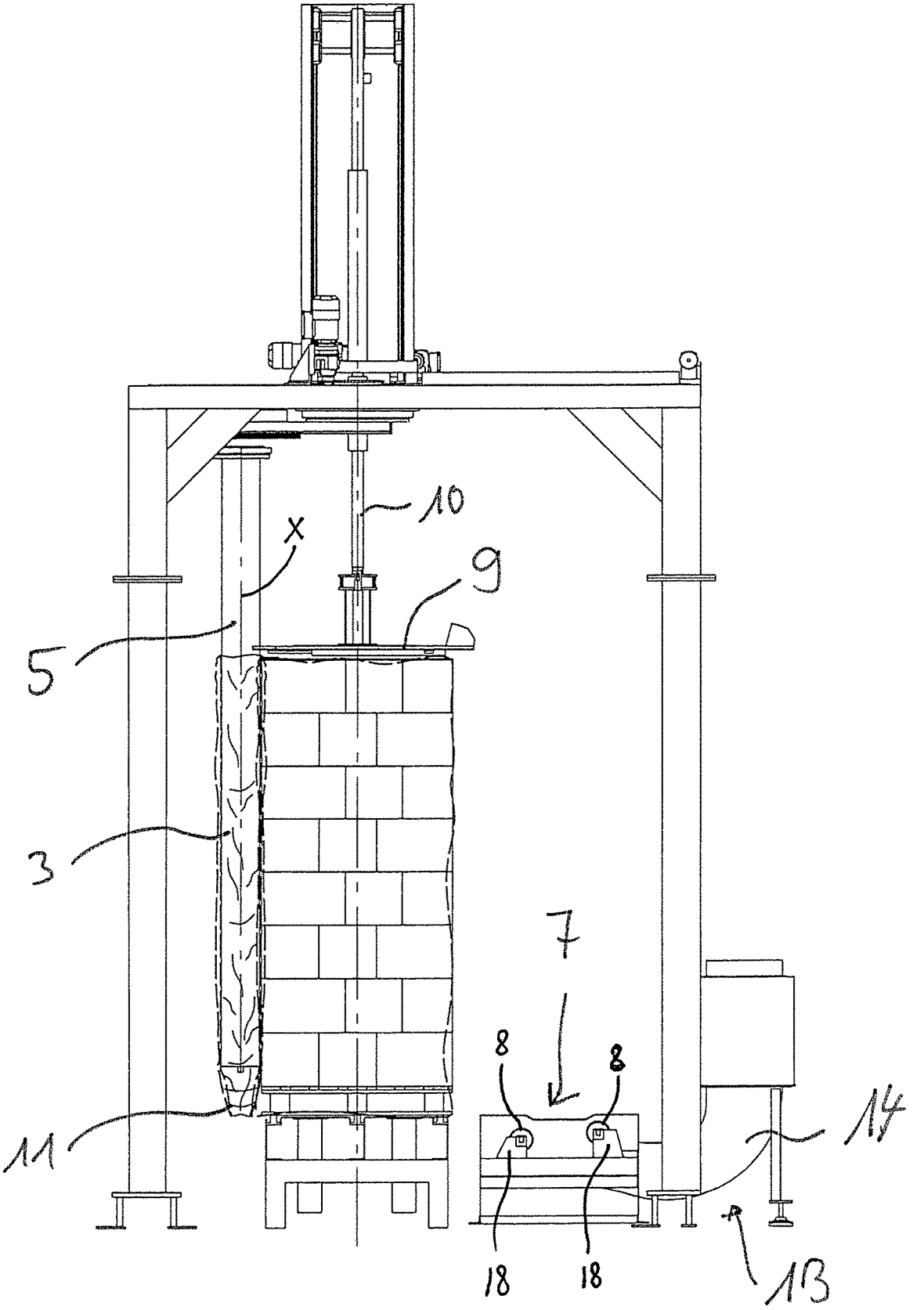

Upon unwrapping, a holddown 9 is usually lowered onto the upper side of goods stack 1 in order to stabilize goods stack 1 during unpacking; this is helpful in particular with products that shift easily, and is visible in FIG. 2. A cylinder 10 is provided in order to raise and lower holddown 9. If film 3 is embodied as a hood, holddown 9 is equipped on its lower side with heating wires 9' arranged in a star shape. Film 3 is cut through in the region of the upper side along heating wires 9'.

In FIG. 2, the holddown 9 is resting on the upper side of the goods stack 1, and the winding mandrel 5 has already unwrapped approximately half of the goods stack 1. In the exemplifying embodiment depicted, the winding mandrel 5 is oriented with respect to the film 3 in such a way that the film 3 wound onto (i.e., around) the winding mandrel 5 protrudes at a bottom with respect to (i.e., away from) the lower end $\mathbf{5}_2$ of the winding mandrel 5, forming a fringe 11.

Figure 3:
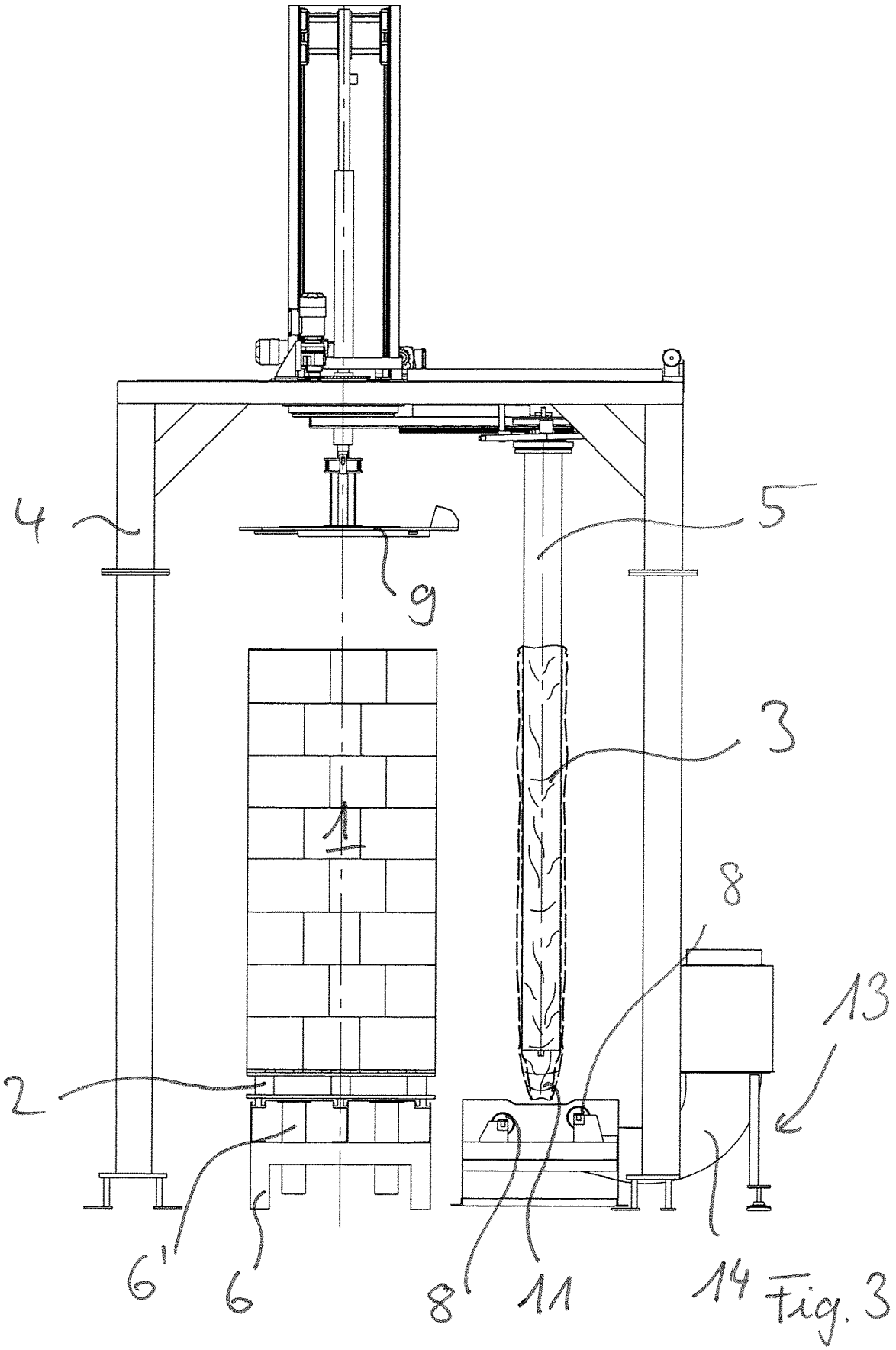

Once winding mandrel 5 has pulled film 3 completely off, winding mandrel 5 is displaced horizontally into its transfer position, this being depicted in FIG. 3. A carriage (not depicted in further detail) is provided for this displacement in the region of the upper end of winding mandrel 5. Fringe 11 does not come into contact with any component, and also not with transfer device 7, in the context of this displacement. Fringe 11 thus cannot "fold over."

Figure 4:
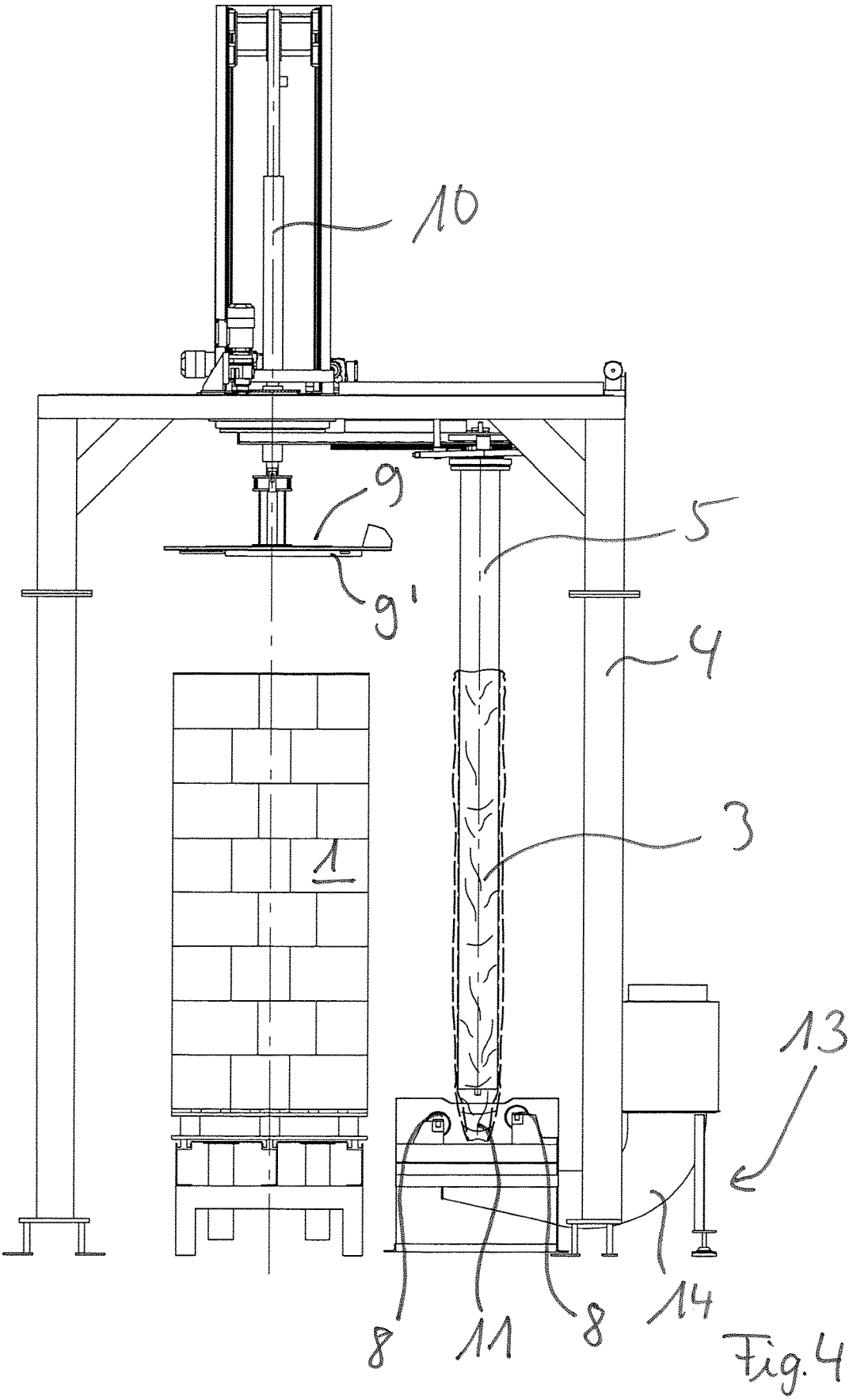

Transfer device 7 is then raised vertically, this being depicted in FIG. 4. Having thus been raised, fringe 11 ends up in the gap between the two rollers 8 and thus in the access region of rollers 8. The clamping connection is released, by displacement of the displaceable bar, before film 3 is pulled off.

Figure 7:
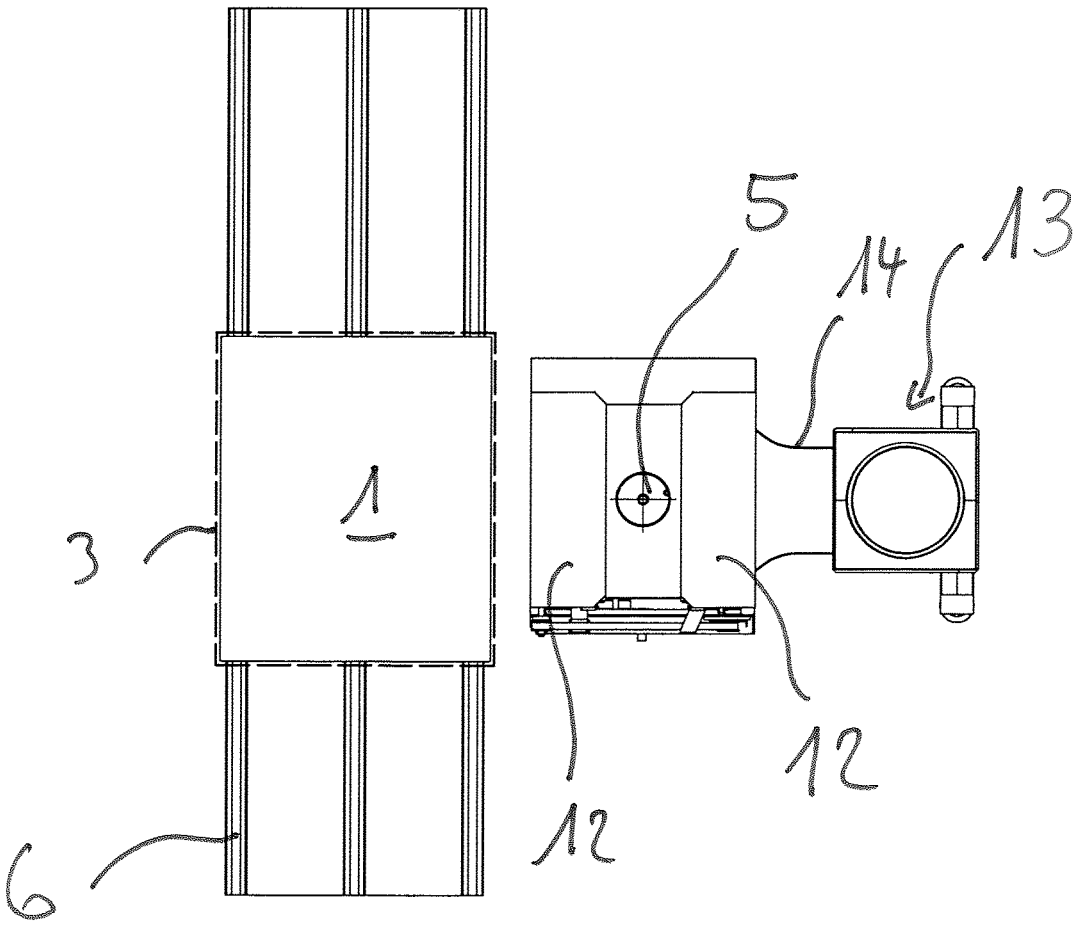
FIGS. 7 to 11 are top views corresponding to the side views of FIGS. 1 to 5.
Figure 8:
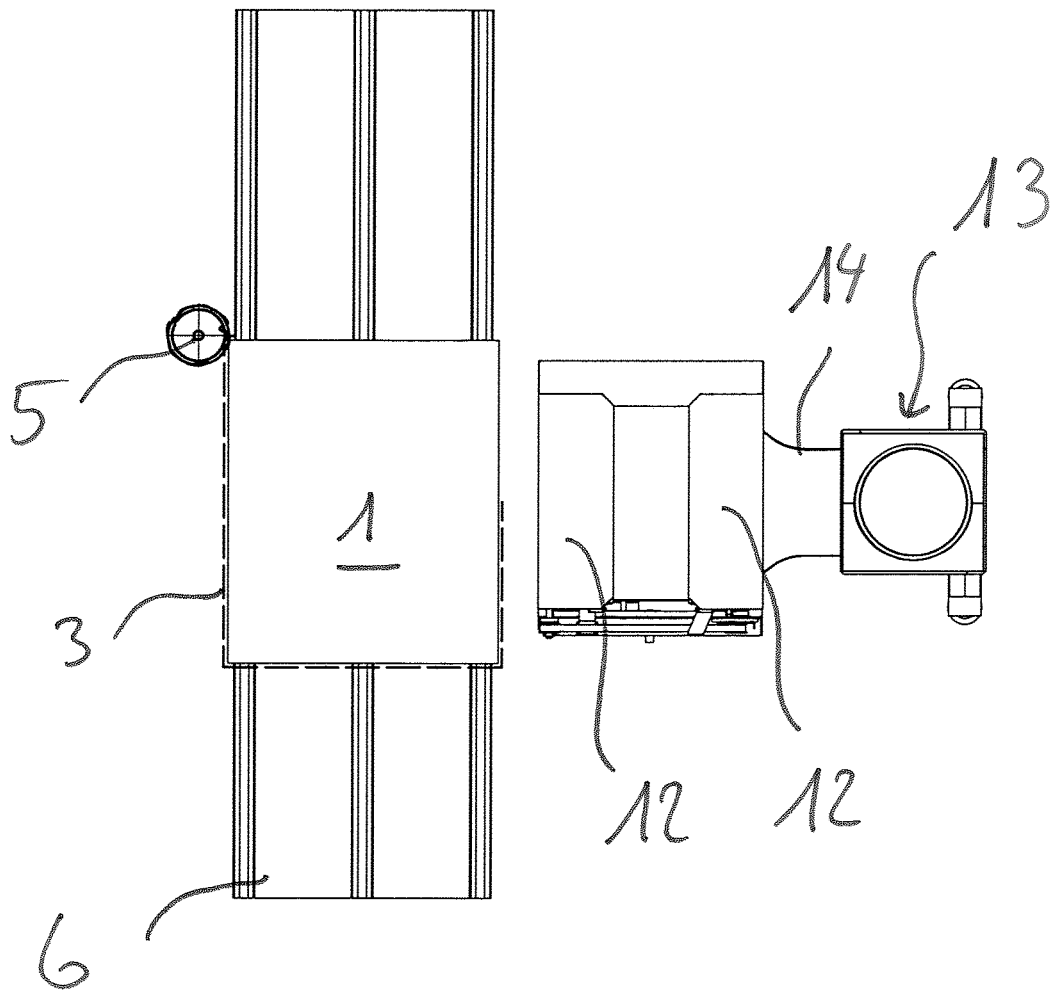

Rollers 8 are then moved toward one another so that the gap becomes smaller and the fringe 11 becomes clamped between the rollers 8. After clamping, at least one of the two rollers 8 is caused to move by means of a drive system (not depicted in further detail) so that the film 3 is pulled downward off the winding mandrel 5 along the longitudinal axis X. In the exemplifying embodiment depicted, for example as is apparent from FIG. 7, in the position in which the gap is largest each roller 8 is covered at the top by a respective panel 12, the panels 12 being arranged so that they form a funnel directed toward the gap.

Figure 5:
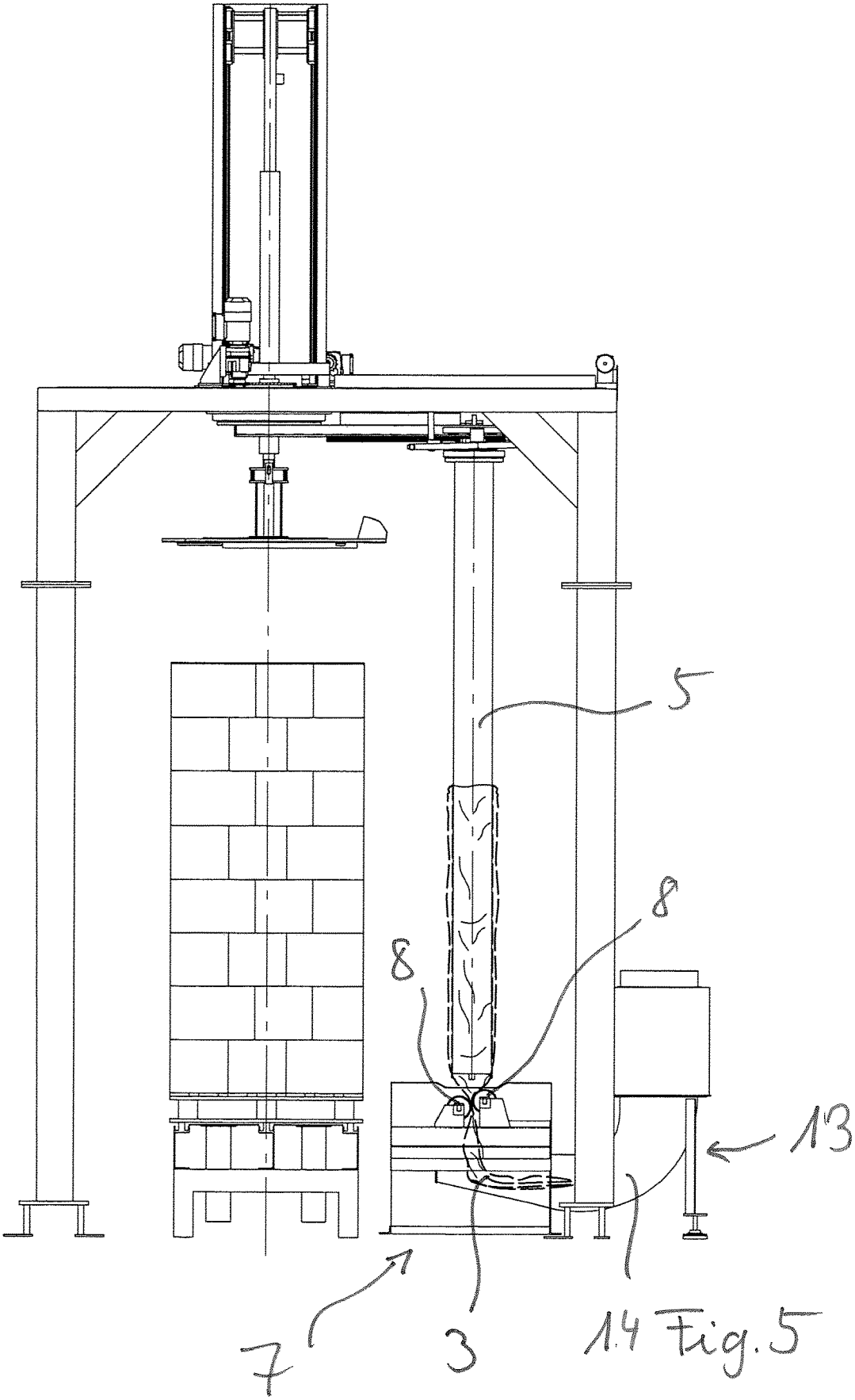

In the embodiment according to FIG. 5, an aspiration system 13, encompassing a suction opening, is provided for further transport of film 3 that is in the process of being pulled off. A conduit 14 is connected to the suction opening. A negative pressure is generated in conduit 14 by means of a blower (not depicted in further detail), so that the pulled-off film is aspirated and can thereby be further transported in conduit 14.

Figure 6:
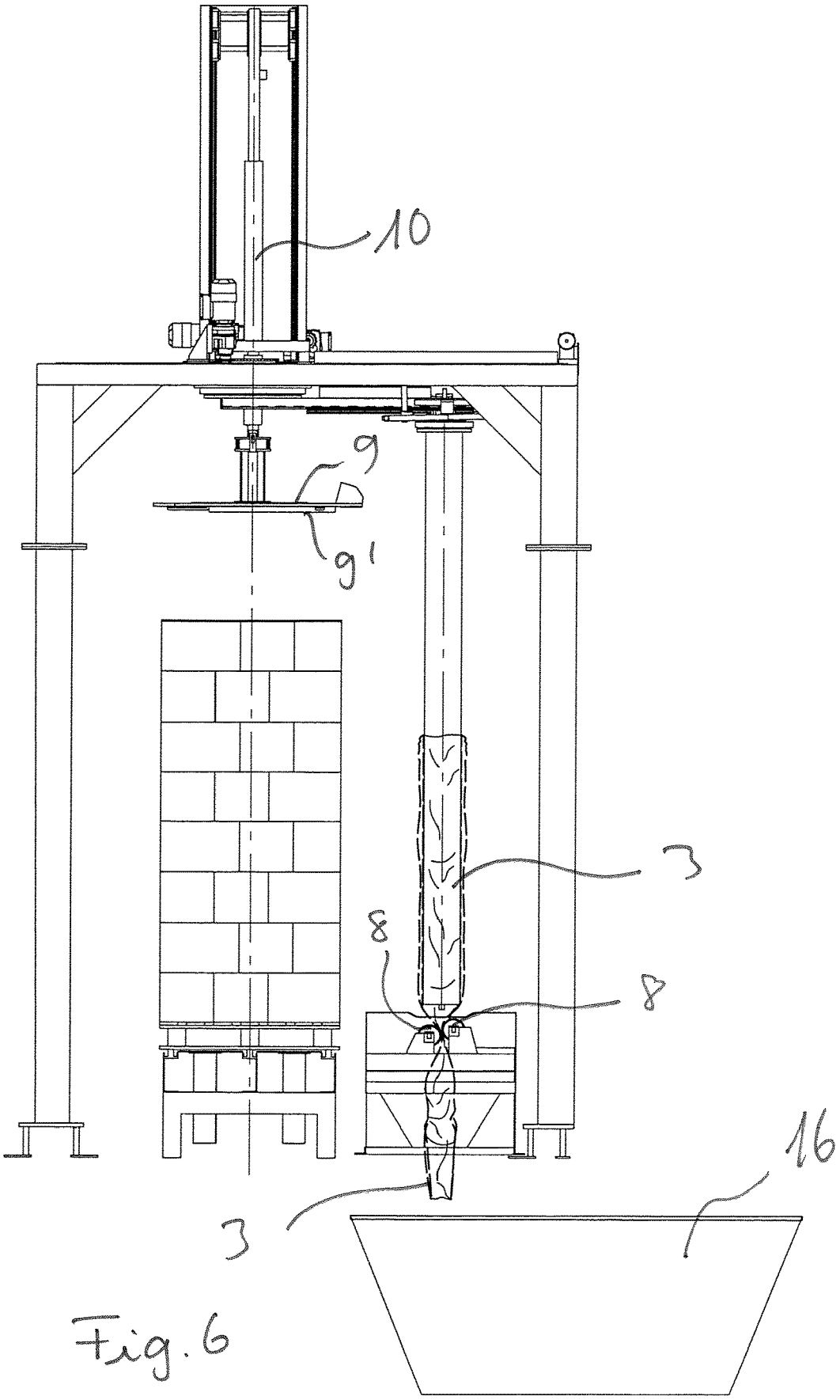
FIG. 6 is a side view of a second exemplifying embodiment of an apparatus according to the present invention.

FIG. 6 shows an exemplifying embodiment in which the pulled-off film 3 is "automatically" delivered to a disposal area, which in the exemplifying embodiment depicted is embodied as a container 16.

Figure 9:
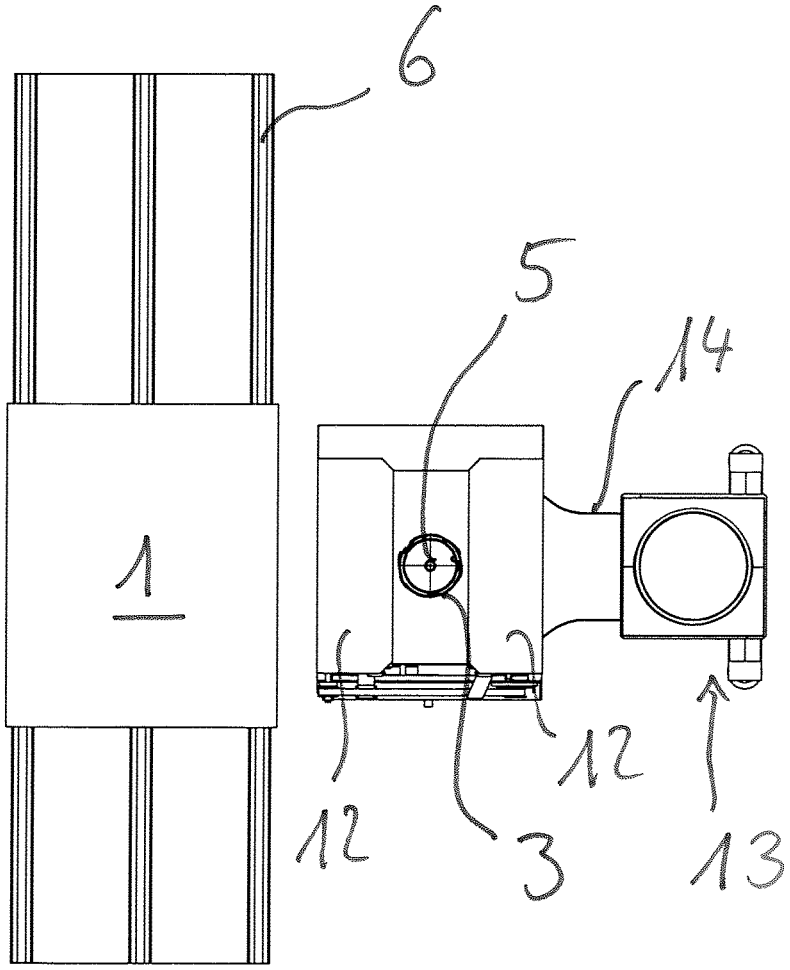
Figure 10:
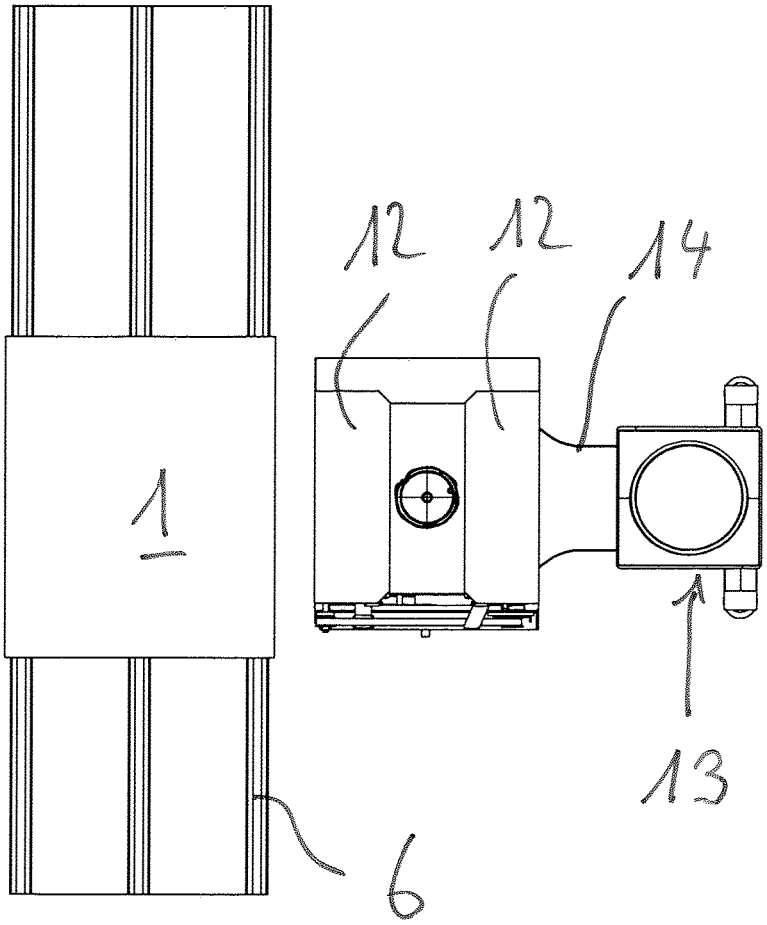
Figure 11:
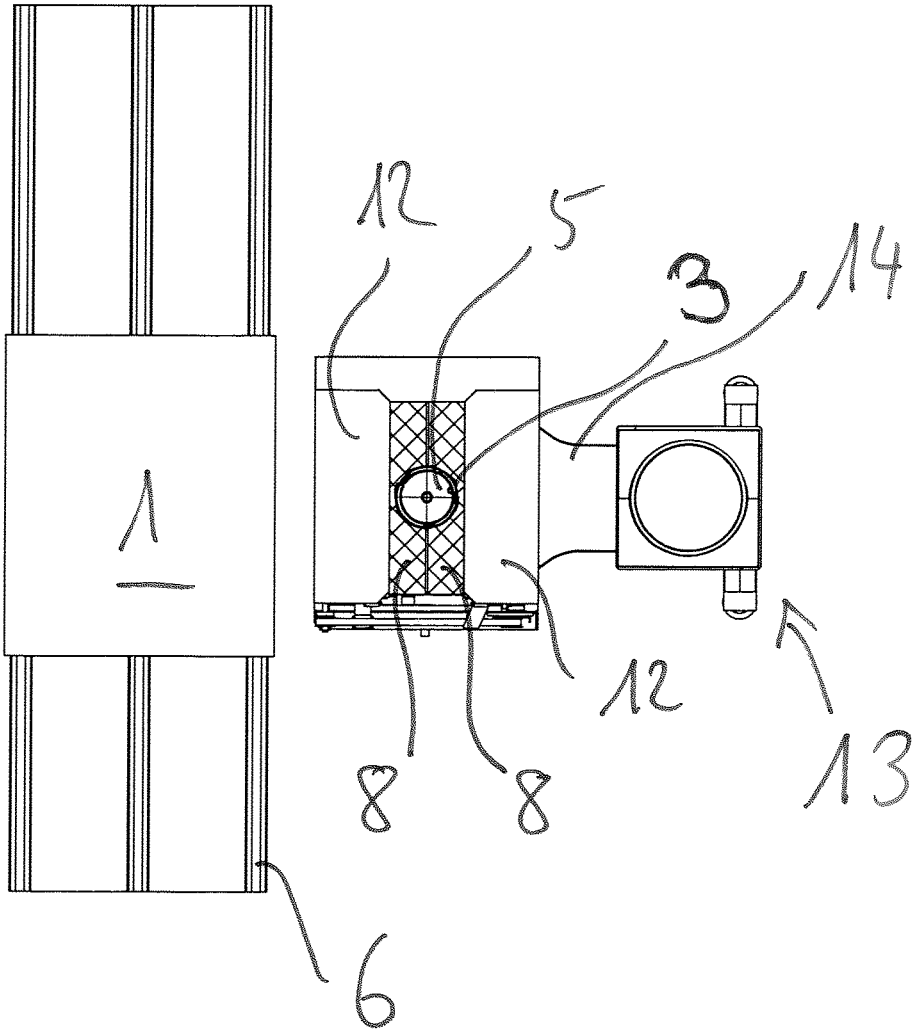
Figure 12:
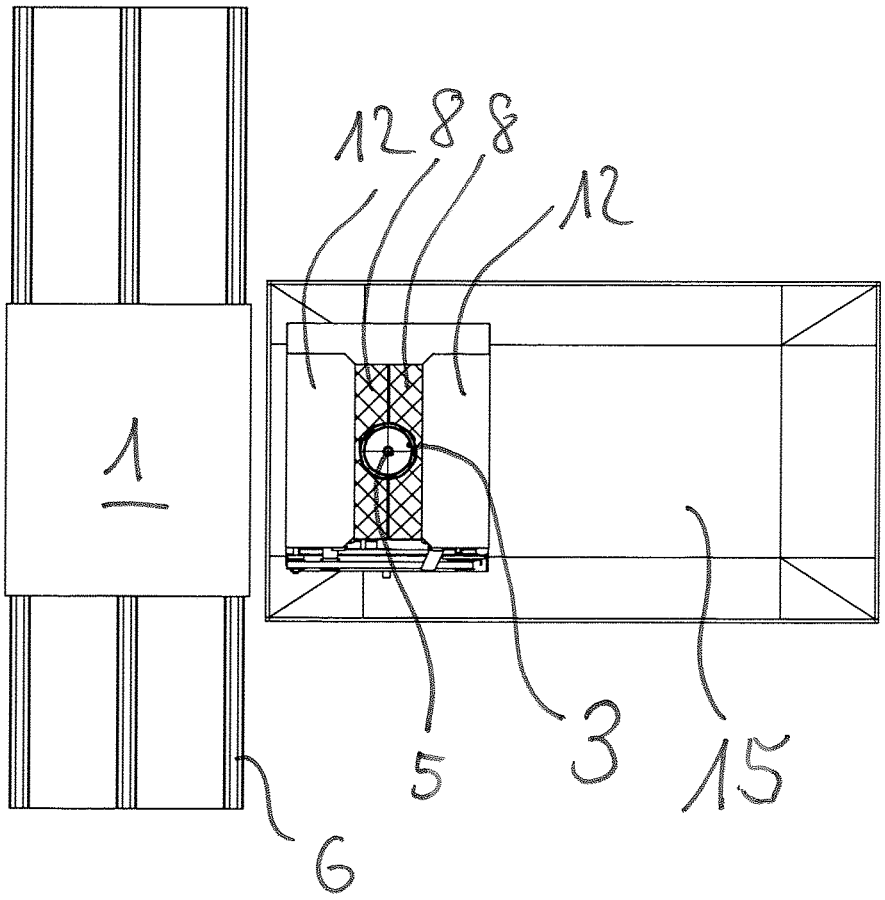
FIG. 12 is a top view corresponding to the side view of FIG. 6.

FIGS. 7 to 12 depict plan views corresponding to the side views of FIGS. 1 to 6. Because FIGS. 3 and 4 differ only in that in FIG. 4 transfer device 7 has already been moved upward, FIGS. 9 and 10 are identical.

We claim:

1. A method for transferring a film (3), the film wound onto a winding mandrel (5) of an unwrapping apparatus, the winding mandrel rotatable around a longitudinal axis X and oriented vertically and supported exclusively at an upper end thereof, the method comprising the steps of:

pulling the film (3) wound onto the winding mandrel (5) off the winding mandrel (5) along the longitudinal axis (X) away from a lower end of the winding mandrel (5) by a transfer device (7) when a transfer position of the winding mandrel (5) is reached; and delivering the film (3) to a disposal area;

the film (3) wound onto the winding mandrel (5) so as to protrude away from the lower end of the winding mandrel (5) and form a fringe (11).

2. The method according to claim 1, wherein the winding mandrel (5) and at least a portion of the transfer device (7) are displaceable relative to one another in at least one of a horizontal direction and a vertical direction.

3. The method according to claim 2, wherein a displacement of at least one of the winding mandrel (5) and the portion of the transfer device (7) occurs without contact between the fringe (11) and the transfer device (7).

4. The method according to claim 1, wherein at least a portion of the transfer device (7) is at least horizontally or vertically displaceable.

5. The method according to claim 1, wherein in the transfer position, the lower end of the winding mandrel (5) is arranged above the transfer device (7).

6. The method according to claim 1, wherein the transfer device (7) includes at least one drivable roller (8) that interacts with an adjacent portion of the winding mandrel (5) in order to pull off the film (3).

7. The method according to claim 1, wherein the transfer device (7) includes at least two rollers (8) that form a gap therebetween and preferably are displaceable with respect to one another in order to modify a width of the gap, and wherein at least one of the at least two rollers (8) is driven by a drive system.

8. The method according to claim 1, wherein the step of delivering the film (3) to the disposal area is carried out by an aspiration system (13) including a suction opening configured for transporting the film (3) that is in the process of being pulled off.

9. An apparatus for transferring a film (3), the apparatus comprising:

an unwrapping apparatus including a winding mandrel (5) rotatable around a longitudinal axis X and configured to wind the film thereon, the film (3) wound onto the winding mandrel (5) so as to protrude away from a lower end of the winding mandrel (5) and form a fringe (11); and a transfer device (7) for pulling off the film (3) along the longitudinal axis (X) of the winding mandrel (5) away from the lower end of the winding mandrel (5);

the winding mandrel oriented vertically and supported exclusively at an upper end thereof;

the transfer device (7) configured for pulling off the film (3) wound onto the winding mandrel (5) along the longitudinal axis (X) away from the lower end of the winding mandrel (5) when the transfer position of the winding mandrel (5) is reached.

10. The apparatus according to claim 9, wherein the winding mandrel (5) and at least a portion of the transfer device (7) are displaceable relative to one another in at least one of a horizontal direction and a vertical direction.

11. The apparatus according to claim 9, wherein at least a portion of the transfer device (7) is at least horizontally or vertically displaceable.

12. The apparatus according to claim 9, wherein the transfer device (7) includes at least one drivable roller (8) that interacts with an adjacent portion of the winding mandrel (5) in order to pull off the film (3).

13. The apparatus according to claim 12, wherein at least a portion of a surface of at least one drivable roller (8) comprises a friction-increasing coating.

14. The apparatus according to claim 9, wherein the transfer device (7) includes at least two rollers (8) that form a gap therebetween and are displaceable with respect to one another in order to modify a width of the gap, and wherein at least one of the at least two rollers (8) is driven by a drive system.

15. The apparatus according to claim 14, wherein the at least two rollers (8) that are closest to the lower end of the winding mandrel (5) are oriented horizontally.

16. The apparatus according to claim 14, wherein the at least two rollers (8) that form a gap therebetween and are closest to an end of the winding mandrel (5) over which the film (3) is configured to be pulled off, are arranged in alignment with the end of the winding mandrel (5) over which the film (3) is to be pulled off.

17. The apparatus according to claim 9, further comprising an aspiration system (13) including a suction opening configured for transporting the film (3) that is in the process of being pulled off to the disposal area.

18. The apparatus according to claim 17, wherein the suction opening is arranged in alignment with an end of the winding mandrel (5) over which the film (3) is to be pulled off.

19. The apparatus according to claim 9, further comprising a delivery device configured to deliver the pulled-off film (3) to the disposal area.

* * * * *